US009188332B2

(12) United States Patent
Louste et al.

(10) Patent No.: US 9,188,332 B2
(45) Date of Patent: Nov. 17, 2015

(54) DEVICE AND METHOD FOR ELECTROSTATICALLY SPRAYING A LIQUID

(75) Inventors: Christophe Laurent Louste, Migne-Auxances (FR); Hubert Romat, Poitiers (FR)

(73) Assignees: Centre National De La Recherche Scientifique, Paris (FR); Universite de Poitiers, Poitiers (FR)

( * ) Notice: Subject to any disclaimer, the term of this patent is extended or adjusted under 35 U.S.C. 154(b) by 746 days.

(21) Appl. No.: 13/498,180

(22) PCT Filed: Sep. 27, 2010

(86) PCT No.: PCT/IB2010/054343

§ 371 (c)(1),
(2), (4) Date: Jun. 5, 2012

(87) PCT Pub. No.: WO2011/039695

PCT Pub. Date: Apr. 7, 2011

(65) Prior Publication Data

US 2012/0228410 A1 Sep. 13, 2012

(30) Foreign Application Priority Data

Sep. 29, 2009 (FR) ..... 09 04634

(51) Int. Cl.
*B05B 5/00* (2006.01)
*F23D 11/32* (2006.01)
(Continued)

(52) U.S. Cl.
CPC . *F23D 11/32* (2013.01); *B05B 1/04* (2013.01); *B05B 1/20* (2013.01); *B05B 1/267* (2013.01);
(Continued)

(58) Field of Classification Search
CPC ..... B05B 5/008; B05B 5/03; B05B 5/0533; B05B 5/0535; B05B 7/065; B05B 7/067; B05B 1/04; B05B 1/20; B05B 1/267; B05B 7/06; B05B 5/0255; F23D 11/32; F23R 3/28; F02M 57/06
USPC ..... 239/3, 290, 296, 423, 424, 451, 455, 239/518, 521, 566–568, 597, 598, 601, 690, 239/690.1, 697, 698, 704, 706, 707, 708
See application file for complete search history.

(56) References Cited

U.S. PATENT DOCUMENTS 4,801,086 A * 1/1989 Noakes ..... 239/3
5,290,600 A * 3/1994 Ord et al. ..... 239/597
(Continued)

FOREIGN PATENT DOCUMENTS

EP 0216502 A1 4/1987
EP 1139021 B1 8/2006
(Continued)

OTHER PUBLICATIONS

International Search Report and Written Opinion for PCT/IB2010/054343 dated Feb. 11, 2011.

*Primary Examiner* — Steven J Ganey
(74) *Attorney, Agent, or Firm* — Hauptman Ham, LLP

(57) ABSTRACT

A spray device includes a nozzle that forms a channel for supplying liquid to at least one opening for spraying the liquid outside the device, and, close to the opening, a first and a second electrode arranged in such a way as to inject electric charges into the liquid. The edge of the opening includes, on one side of the channel, at least one projecting end of the first electrode that projects into the channel and is to be brought into contact with the liquid, and on the other side of the channel, an electrically insulating nozzle body in which the second electrode is embedded adjacently to the first electrode, in such a way that the intensity of the electrostatic field in the or each projecting end is maximized.

17 Claims, 9 Drawing Sheets

Figure 1:
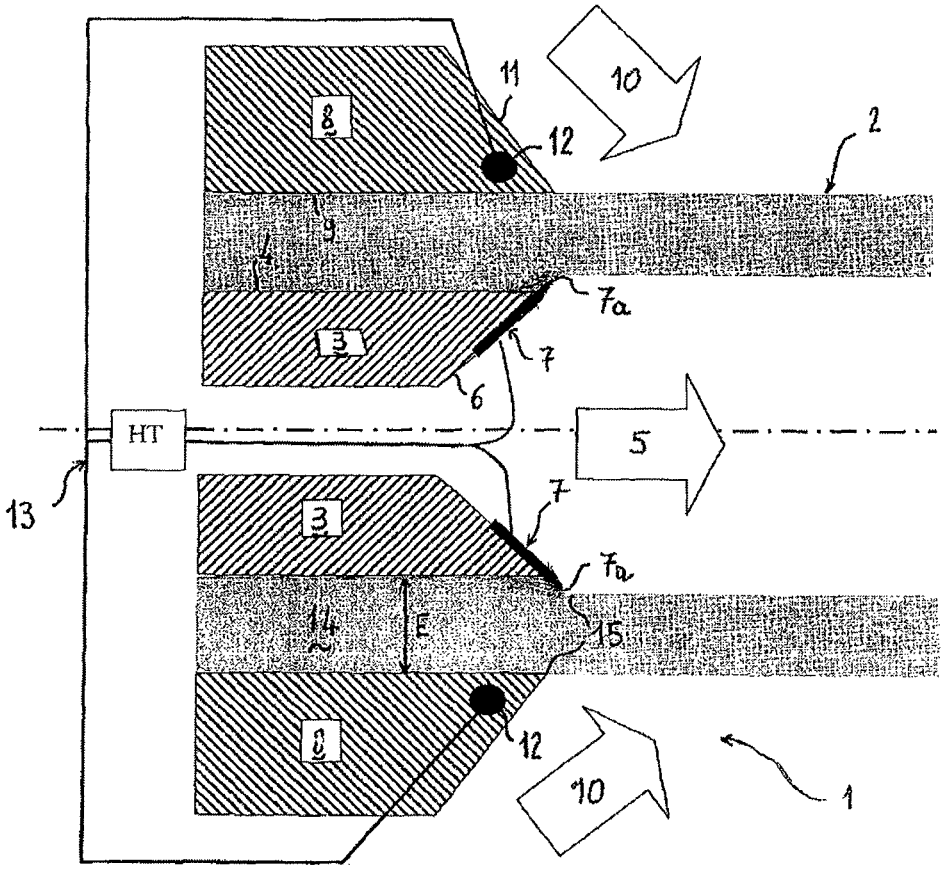

(51) Int. Cl.

| | |
|---|---|
| ***B05B 1/04*** | (2006.01) |
| ***B05B 1/20*** | (2006.01) |
| ***B05B 1/26*** | (2006.01) |
| ***B05B 7/06*** | (2006.01) |
| ***B05B 5/025*** | (2006.01) |
| ***B05B 5/03*** | (2006.01) |
| ***B05B 5/053*** | (2006.01) |
| ***F23R 3/28*** | (2006.01) |
| *F02M 57/06* | (2006.01) |

(52) U.S. Cl.

CPC ..... *B05B 5/008* (2013.01); *B05B 5/0255* (2013.01); *B05B 5/03* (2013.01); *B05B 5/0533* (2013.01); *B05B 5/0535* (2013.01); *B05B 7/06* (2013.01); *F23R 3/28* (2013.01); *B05B 7/065* (2013.01); *B05B 7/067* (2013.01); *F02M 57/06* (2013.01)

(56) References Cited

U.S. PATENT DOCUMENTS

| | | | | |
|---|---|---|---|---|
| 6,123,269 | A | 9/2000 | Schmitkons et al. | |
| 7,914,262 | B2 * | 3/2011 | Hanaoka et al. | 239/690 |
| 2004/0075003 | A1 | 4/2004 | Leuteritz et al. | |
| 2006/0081728 | A1 * | 4/2006 | Willey et al. | 239/690 |
| 2008/0173327 | A1 | 7/2008 | Miyagi | |

FOREIGN PATENT DOCUMENTS

| | | | |
|---|---|---|---|
| GB | 2096022 | A | 10/1982 |
| GB | 2312298 | A | 10/1997 |
| GB | 2442210 | A | 4/2008 |
| WO | 2006079111 | A2 | 7/2006 |
| WO | 2008052830 | A1 | 5/2008 |

* cited by examiner

DEVICE AND METHOD FOR ELECTROSTATICALLY SPRAYING A LIQUID

RELATED APPLICATIONS

The present application is a National Phase of International Application Number PCT/IB2010/054343, filed Sep. 27, 2010, and claims priority from, French Application Number 0904634, filed Sep. 29, 2009.

The present invention relates to a device and a method for spraying, in particular in the form of a sheet, a liquid that can be electrically insulating at least through electrostatic forces, the device being designed to atomize this liquid or to control the oscillations thereof by generating beats therein. The invention also relates to a fuel injector for a combustion chamber of a heat engine incorporating this device, as much for land vehicles as for air or space vehicles, and other uses of this device such as, for example, in the fields of electrohydrodynamic pumps for heat exchangers, cooling onboard systems by vaporizing heat-transfer liquids, atomizing cutting oils or even cleaning surfaces, to give a few nonlimiting examples.

The atomization of a fuel is an essential step for all heat engines, because the rate of pollution and the efficiency of a heat engine are intimately linked to the fuel atomization quality. In the aeronautical engines of jet engine type, the atomization is obtained by disintegration of a fuel sheet. To obtain this disintegration in a jet engine, a shearing jet of air blown at high speed (typically at 200 m/s) into the combustion chamber, which impacts on the sheet of fuel and atomizes it, is generally used.

To improve this efficiency and reduce the pollution caused by these jet engines, it is therefore necessary to correctly control the atomization, which is performed in a relatively satisfactory manner at normal operating speed given that the atomization device is engineered to operate correctly when the aircraft is at cruising speed.

However, the same does not apply for the other speeds and, in particular at low speed, when, for example, the airplane is rolling on the runway. At that moment, the air which enters into the combustion chamber usually reaches only a speed of approximately 30 m/s, which is insufficient to correctly atomize the fuel which therefore burns badly and results in both a loss of power and pollution. The solution adopted by the aeronautical manufacturers then consists in having a number of injection systems in the same aircraft corresponding to as many operating speeds, which has the drawback of being a solution which is complex, costly, heavy and which also increases the risks of failures. Other drawbacks with this multiplicity of injectors lie in the lack of flexibility of the device which does not allow for a continuous transition from one operating speed to another and in the inadequacy of the results obtained by the low speed injectors (the speed of the jet of air being too low at low speed, the atomization can then only be partial).

To provide a solution to these pollution problems, new injectors have been developed, still on the same abovementioned principle of shearing air jets, to obtain mists with a low concentration of fuel. Although effective in terms of pollution, it nevertheless happens that the poverty of the fuel mixture causes the engine to switch off. The reignition of the engine is then difficult if at altitude (where the pressure is low and the air intake may, for example, be at −45° C.)

Another pathway recently explored consists in electrifying the fuel before its atomization in a jet engine by the electrostatic injection of electric charges into a jet of fuel circulating at high speed. The article by Priol L, Baudel P, Louste C, Romat H, entitled "Laser granulometry measurements on electrified jets for different lengths of injector", Journal of electrostatics, vol. 63, pp. 899-904, 2005, teaches using such an electrostatic atomization of a fuel circulating at an average speed of between 40 and 100 m/s by means of a nozzle with symmetry of revolution incorporating an electrode in the form of an axial needle linked to a high voltage source and a substantially radial counter-electrode linked to the ground which is arranged downstream of the needle in the nozzle and which, like the other electrode, is intended to be in contact with the fuel. This counter-electrode is provided upstream of a terminal axial duct of this nozzle of length L and of diameter D (with L/D varying from 2 to 10) through which flows the electrified fuel before being atomized out of the nozzle through the outlet orifice of this duct.

The document WO-A1-2008/052830 presents a nozzle for atomizing an electrically conductive fuel incorporating a radial flat electrode in the form of a ring which is housed between two electrically insulating radial layers and whose inner edge is pointed upstream of the orifice for spraying the fuel out of the nozzle. This conductive fuel is first driven in rotation upstream of this electrode and according to an axis of rotation perpendicular to said electrode, then comes into contact with this pointed electrode edge before being sprayed out of the nozzle.

The document EP-B1-1 139 021 presents an atomization nozzle ending with two axial metallic electrodes which are intended to be in contact with the fuel and which alone define the edge of the orifice for spraying the fuel out of the nozzle.

The major drawback with this last atomization device with electrodes which are both not electrically insulated lies in the relatively low value of the intensity of the electrostatic field generated by these electrodes, which adversely affects the atomization quality obtained.

One aim of the present invention is to propose a device for spraying, in particular in the form of a sheet, a liquid that can be electrically insulating at least through electrostatic forces which remedies all the abovementioned drawbacks, this device being designed to atomize this liquid or to control the beat of the oscillations thereof and comprising a nozzle which forms a channel for feeding the liquid to at least one orifice for spraying said liquid out of the device and which incorporates, in proximity to this orifice, a first electrode and a second electrode configured to inject electric charges into the liquid.

To this end, a liquid spraying device according to the invention is such that the edge of this orifice comprises, on one side of the channel, at least one protruding end of the first electrode which protrudes into this channel and which is configured to be in contact with the liquid and, on another side of the channel, an electrically insulating nozzle body in which the second electrode is embedded adjacent to the first electrode, so that the intensity of the electrostatic field at said or each protruding end is maximized.

It will be noted firstly that a device according to the invention defined in this way makes it possible not only to optimally atomize, in the form of a sheet, a liquid which may be initially not electrically charged, such as a diesel fuel (it being specified that the expression "electrically insulating" should be understood to mean that this liquid has a resistivity equal to or greater than $10^8$ Ω·m), but also to control the variation of the amplitude of the oscillation of the sprayed sheet in the non-atomized state.

The term "sheet" should be understood in this description to mean a thin film whose thickness may typically vary from 200 μm to 500 μm and which defines a surface which may be flat or three dimensional, advantageously in the latter case having symmetry of revolution and delimiting an internal space, unlike a three-dimensional jet of liquid which by definition is solid and therefore does not define any internal space.

It will be noted that the device according to the invention, which may be based only on the use of a Coulomb force, is capable of injecting electrical charges into the fuel as it is sprayed out of the device (i.e. simultaneously) with a local electrostatic field of extremely high intensity being obtained, by virtue of the specific arrangement of the two electrodes, one of which forms the output end of the nozzle via its protruding end (i.e. pointed or sharp according to a small radius of curvature) and the other end of which is electrically insulated by being immediately adjacent to this output end and, consequently, to the other protruding electrode. True forced injection of the electric charges into the fuel is then obtained locally, and the Applicant has verified that the intense electrostatic effects obtained in this way disturb the sheet of fuel, even cause it to explode, with an optimization of the secondary atomization of the sheet and a uniformity of the mist of droplets obtained which is enhanced, compared to the atomizations obtained by the abovementioned known devices.

It should be remembered that the expression "primary oscillation" in terms of an atomized sheet of fuel should be understood, as is known, to mean longitudinal waves of small amplitude relative to the thickness of the sheet and corresponding to an oscillation interface and that downstream of this primary oscillation, ligaments are formed in the direction of flow. These ligaments, which correspond to a so-called secondary oscillation, are evenly spaced in the transversal direction of the sheet and are separated by fine membranes which break under the effect of aerodynamic forces and form a mist of small droplets. These ligaments are in turn broken to form a population of liquid clusters of relatively large size, the creation of these clusters corresponding to the end of the primary atomization phenomenon. As for the secondary atomization, it corresponds to the disintegration of these unstable clusters into smaller droplets because of the kinetic pressure which opposes the surface tension forces.

According to another preferential characteristic of the invention, said channel is delimited by first and second electrically insulating nozzle bodies which are mounted facing one another and which respectively incorporate said first and second electrodes in profiled regions of these bodies ending at said spraying orifice, the first electrode extending on a first wall inside said channel defining the profiled region of the first body and ending beyond this wall by said or each end protruding into the channel, and the second electrode being adjacent to a second wall outside the channel defining the profiled region of the second body.

Advantageously, said or each protruding end can have a main radius of curvature of between 5 μm and 15 μm and is preferably pointed, said spraying orifice having a smaller transversal dimension of between 100 μm and 500 μm. It will be noted that this small radius of curvature combined with the insulation of the second electrode makes it possible to obtain a very significant, local electrostatic field, with an intensity that can be greater than 1 MV/cm at said or each protruding end when an alternating voltage (with an amplitude preferably equal to several kV and, for example, at least equal to ±20 kV) is applied between the first and second electrodes.

According to another characteristic of the invention, said first electrode may be overall rectilinear in longitudinal section, said second electrode possibly having a convex outer surface which is preferably elliptical or circular in longitudinal section, this convex or rounded form making it possible to minimize the intensity of the electrostatic field at this surface.

Advantageously in the case of the preferential use of a fuel as liquid, the device of the invention is such that said first nozzle body has a relative permittivity $\in_r$ preferably less than or equal to 10 (even more preferentially, less than or equal to 5), and that said second nozzle body has a relative permittivity $\in_r$ equal to or greater than 2 (preferably equal to or greater than 5) so as to further maximize the intensity of the electrostatic field in the vicinity of said first electrode. To avoid the breakdown of the device, this second electrode is thus placed inside an insulating material of high permittivity to transmit the electrical field but above all of strong dielectric strength so as to not to breakdown (ceramics satisfy this dual constraint and can therefore be used to form the second nozzle body). This second electrode is thus entirely protected by this insulating material and is designed to never be in contact with the fuel or with the air. Examples of materials that can be used to form all or part of these two nozzle bodies include, in addition to ceramics, PVC and "Plexiglas", cited as nonlimiting examples. Materials that can be used to form said first and second electrodes include all materials that are electrically conductive but also chemically neutral with respect to the liquid to be sprayed.

To atomize this fuel in the form of a sheet, this device according to the invention can also be provided with means to supply at least one gaseous flow, such as a jet of air, downstream of said spraying orifice so as to further optimize this atomization.

According to a first embodiment of the invention, said channel has a substantially rectangular transversal section so as to spray the liquid in the form of a flat sheet, said first electrode having overall the form of a flat blade and said second electrode having a bar-shaped geometry, each electrode being independently continuous or discontinuous (for example like a comb) seen in transversal section.

According to a second embodiment of the invention, said channel has an overall annular transversal section (e.g. elliptical or circular) so as to spray the liquid in the form of a sheet with symmetry of revolution, said first electrode having a substantially divergent tapered form toward said or each protruding end and said second electrode having a substantially toroidal form concentrically surrounding the first electrode, each electrode being independently continuous or discontinuous seen in transversal section.

Preferentially according to this second embodiment, said first nozzle body is situated radially inside said second nozzle body which surrounds it concentrically so that said first and second walls are respectively divergent and convergent toward said channel, and said means for feeding the gaseous flows are located radially inside this first body and radially outside this second body.

It will be noted that the device according to this second embodiment of the invention does not require any modification to the geometry of the current injectors, the electrostatic action being able to be used alone or else superimposed on the usual mechanical action of the jet of air on the sheet to increase the effectiveness and safety thereof. In practice, it is sufficient to provide said electrodes this current injector with two concentric internal and external nozzle bodies forming such radially internal and external flows of air and with respectively divergent and convergent end walls, the structure of these two nozzle bodies otherwise being able to be unchanged.

It will be also noted that the device of the second embodiment according to the invention makes it possible to considerably simplify the current injection systems on aircraft by eliminating the injectors dedicated to low operating speeds, since this device of this invention is capable of ensuring this atomization at low speed by the electrostatic force according to the invention complemented by air intakes due to a shear wind for example of 30 m/s. This device of this invention thus has a structure that is simple (only two electrodes have to be provided), inexpensive (since the conventional manufacturing techniques with jets of air can be used), can operate at all speeds, including on the ground, consumes very low electrical power (only a few watts) and is extremely robust and therefore subject to little wear because it does not have any moving parts, unlike certain known devices which implement a rotation of the fuel.

Furthermore, this device according to the second embodiment of the invention can be used to assist in reigniting the engine by atomizing the large quantity of fuel needed.

An injector according to the invention of a fuel that is, for example, electrically insulating, for a combustion chamber of a heat engine of a land, air or space vehicle, in particular for an airplane jet engine, comprises a device suitable for atomizing this fuel in the form of a sheet as defined above and, preferably, according to this second preferential embodiment of the invention, with said gaseous flows which are located radially inside said first body and radially outside said second body.

As indicated previously, it should be noted that this injector is in particular characterized by the position of the two electrodes which are situated as close as possible to the output of the injector (i.e. the injection lip of the nozzle), it being specified that, preferably, this injector lip is partly formed by the first electrode injecting the charges into the fuel reaching it, with the creation of the abovementioned intense electrostatic forces which destabilize the film of fuel to atomize it in sheet form.

It will also be noted that the electrostatic atomizing means included in an injector according to the invention can be used alone to atomize the fuel, i.e. without mechanical blowing means, but that the combination of these two means makes it possible to increase the performance and the reliability of the aircraft, in particular in case of failure of one of these two electrostatic and mechanical means, the other assuming the task.

It will also be noted that an injector according to the invention has a small bulk, because the space needed to install these electrostatic means (i.e., essentially, the two electrodes, the high voltage source and an electronic control device) is reduced, and represents an ecological gain since the optimizing of the vaporization is accompanied by a better combustion, and therefore lower consumption, and consequently a reduction in the pollution created.

Other uses according to the invention of a device as defined above may consist, as a nonlimiting example, in atomizing a liquid chosen from the group consisting of heat-transfer liquids, cutting oils for machine tools and liquids for cleaning soiled surfaces, or else in producing an electro-hydrodynamic pump for a heat exchanger without rotating parts for example intended to equip an air or space vehicle with heat engine.

A method according to the invention for spraying, at least by electrostatic forces and in particular in sheet form, a liquid that may be electrically insulating, such as a fuel, by atomizing it or by controlling the beat of the oscillations thereof, consists in using a device as defined above by applying, between said first and second electrodes, an alternating voltage signal, the amplitude of which is preferably several kV and is, for example, at least equal to ±20 kV, to obtain a local electrostatic field at said or each protruding end in contact with the liquid with an intensity greater than 1 MV/cm and that can reach 10 MV/cm, electrical charges thus being directly injected into the liquid leaving the device at this end.

It will be noted that the use of an alternating signal is essential to the correct operation of the device according to the invention, to avoid the build-up of electrical charges on the surface of the solid dielectric which separates the first and second electrodes.

According to another characteristic of the invention, the Applicant has discovered that a use of particular electrical signals allows for a fine and rapid modulation of the electric action according to the needs of the fuel injector and depending on whether the aim is to atomize the fuel or else to control the beat thereof when it is not atomized.

Furthermore, the modulation of the electrical signal makes it possible to obtain an immediate or progressive variation of the behavior of the injector by these electrostatic means, this modulation making it possible to continually adapt the operation of the injector in the event of speed changes, by virtue of an electronic control device used together with the injector.

To atomize this liquid, it is advantageously possible to use a frequency of this signal at least equal to 1 kHz, this signal preferably being square with, for example, a frequency equal to or greater than 2 kHz and a rise time of around 400 V/μs. It will nevertheless be noted that all the other existing forms of alternating signals can be used to obtain this atomization, such as, for example, sinusoidal, triangular, or even pulsed signals.

To control the beat of the oscillations of this liquid without atomizing it, it is advantageously possible to use a frequency of this signal of between 5 Hz and 100 Hz, this signal preferably being of sinusoidal or triangular type and with a frequency substantially equal to 50 Hz. It will be noted that this control of the beat is particularly useful in cases where one or more air jets are associated, in addition to these electrostatic means.

According to another preferential characteristic of the invention, the liquid is set in motion in said channel with a speed of between 0.5 m/s and 2 m/s, and a sheet that is substantially flat or with symmetry of revolution for the sprayed liquid with a thickness of between 200 μm and 500 μm is obtained, preferably by also feeding at least one gaseous flow, such as a jet of air, downstream of said spraying orifice and at a speed for example of between 30 m/s and 200 m/s, to optimize the atomization of the fuel sprayed by the device.

Figure 2:
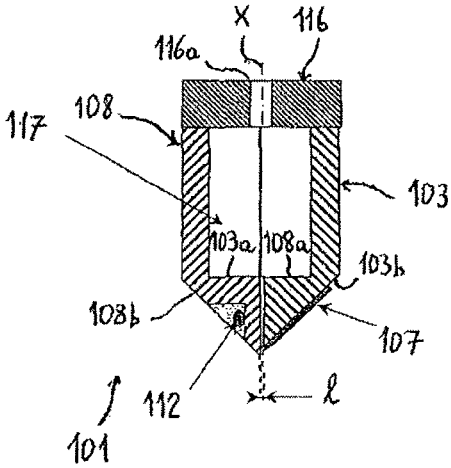
Figure 3:
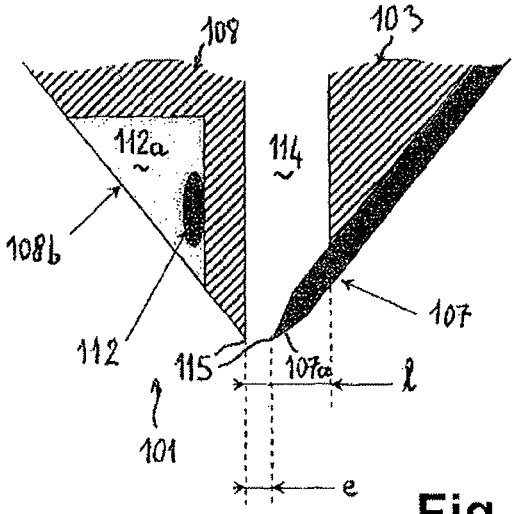
Figure 4:
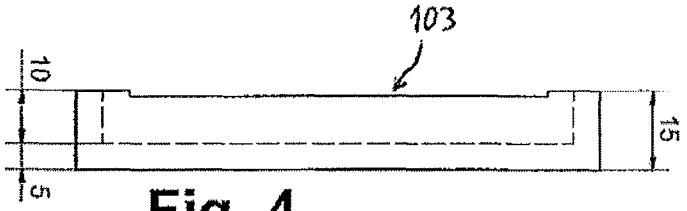
Figure 6:
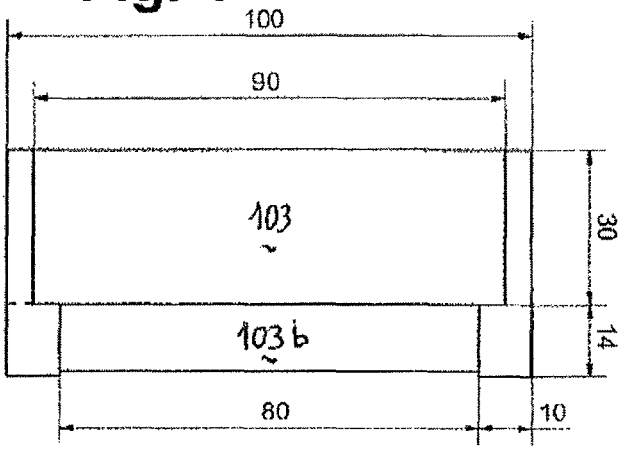
Figure 5:
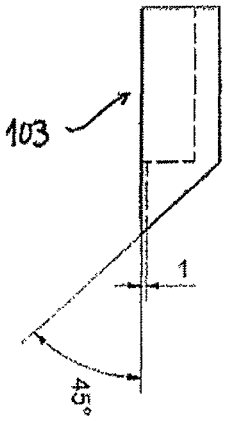
Figure 7:
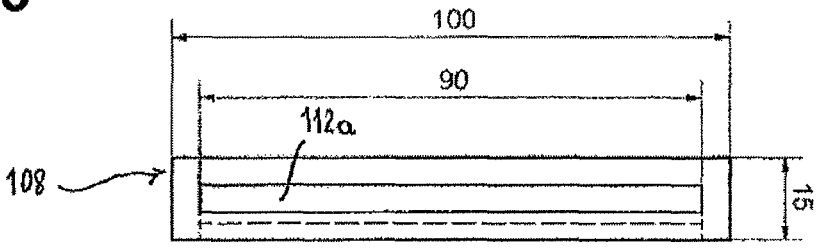
Figure 8:
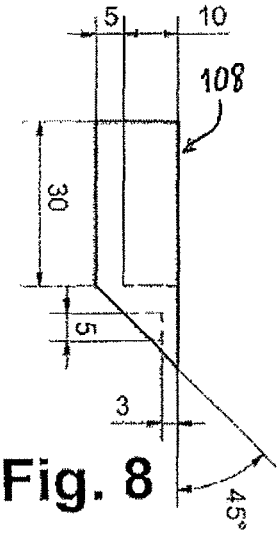
Figure 9:
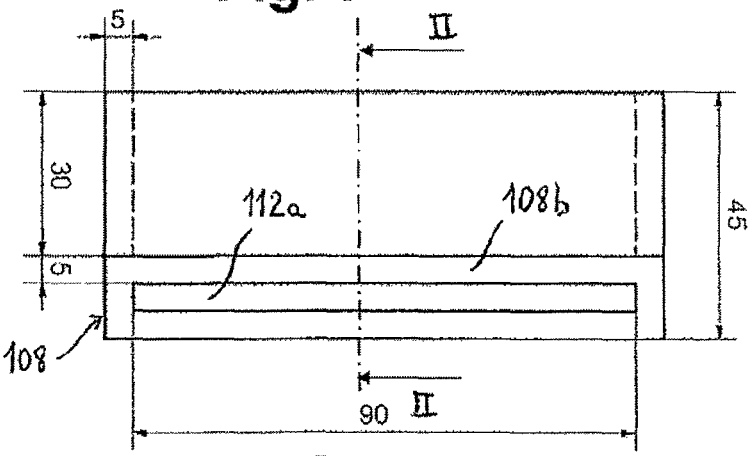
Figure 10:
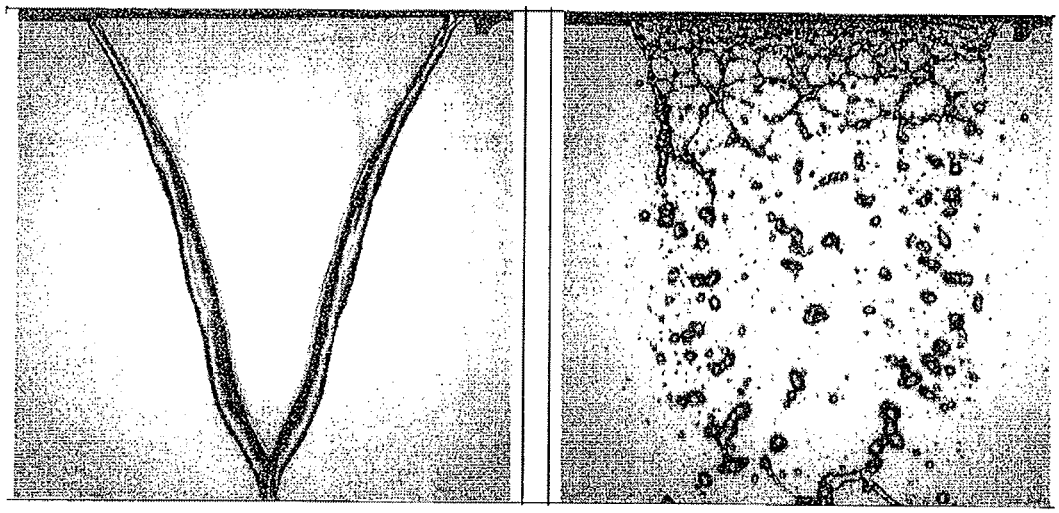
Figure 11:
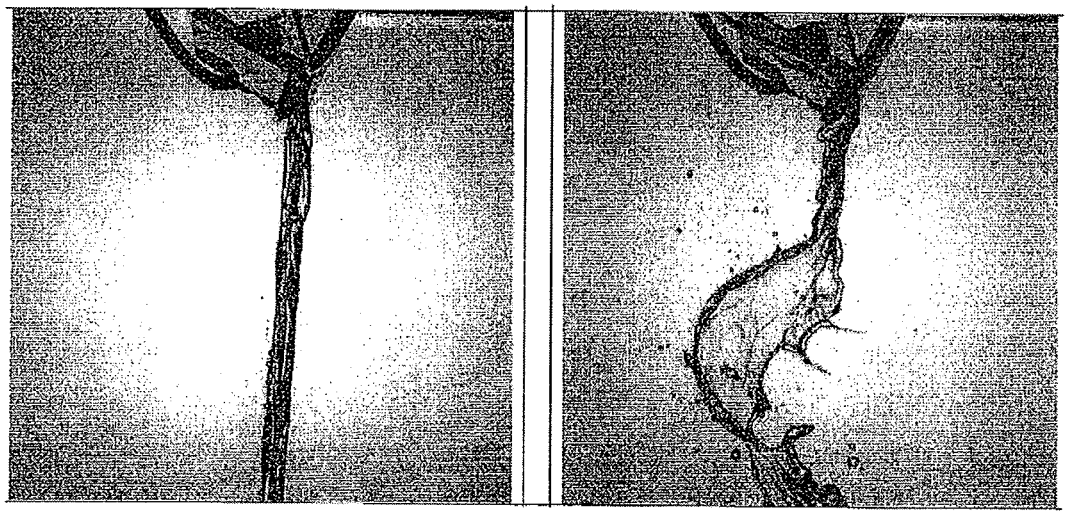
Figure 12:
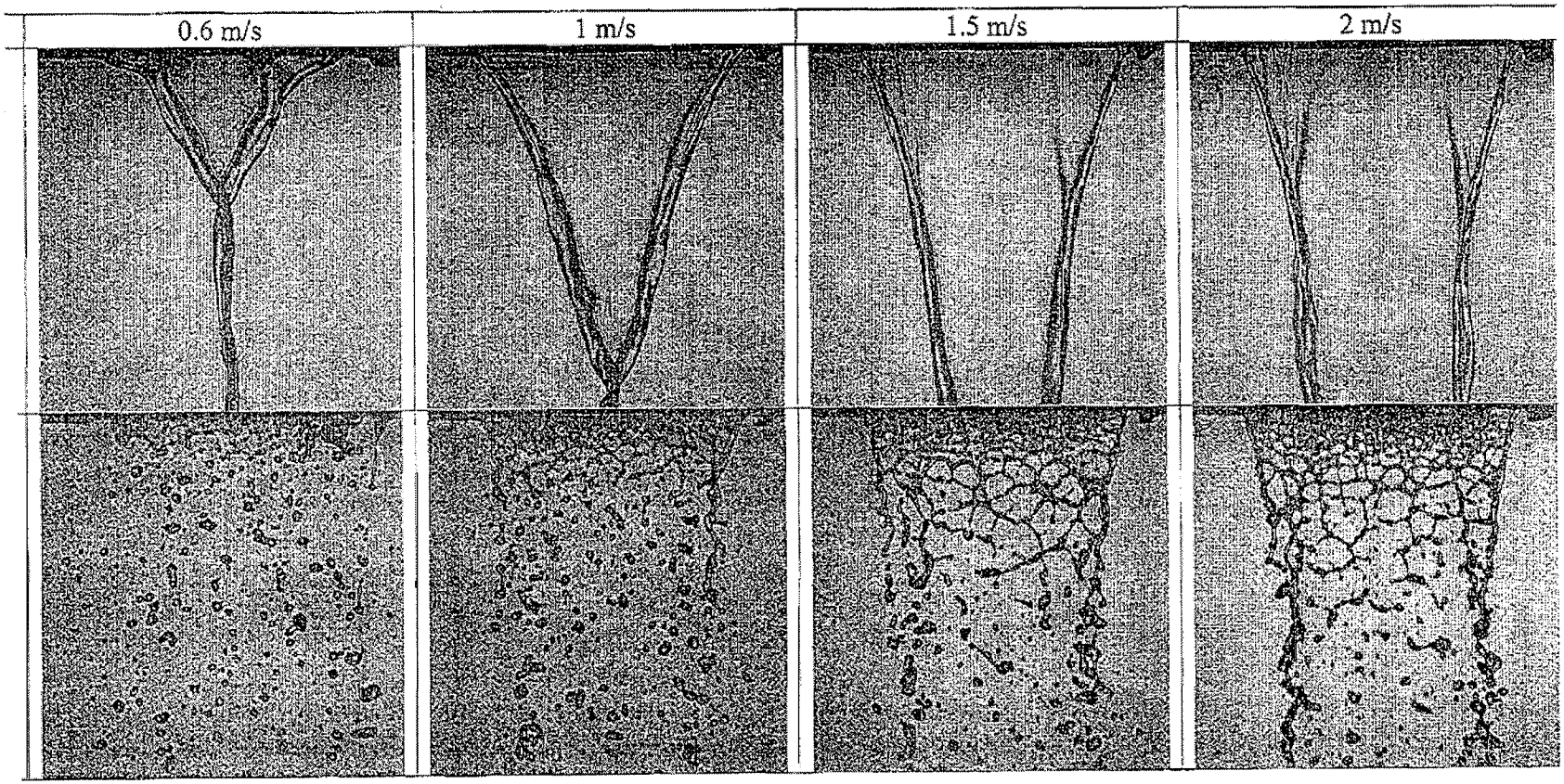
Figure 13:
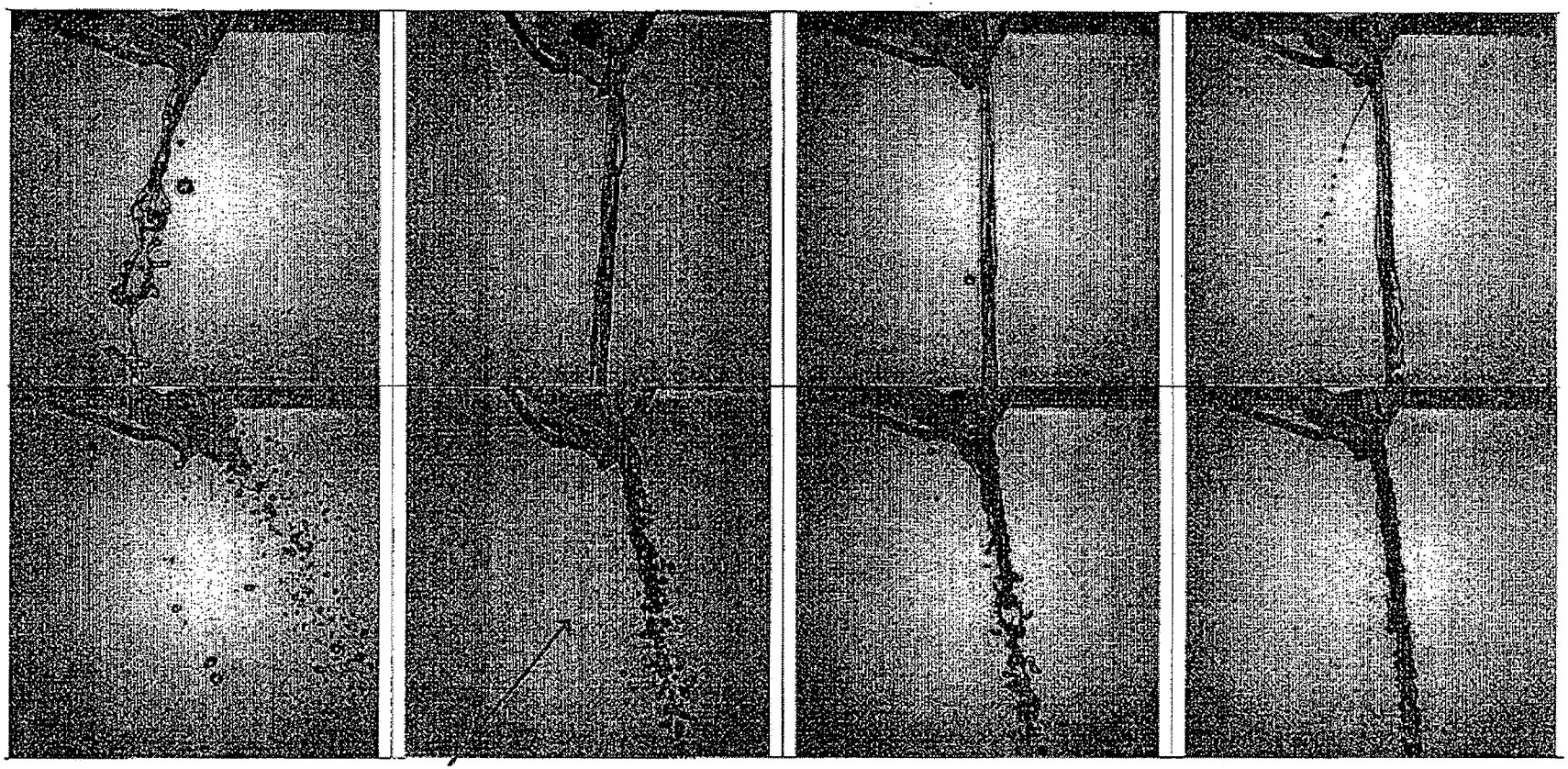
Figure 14:
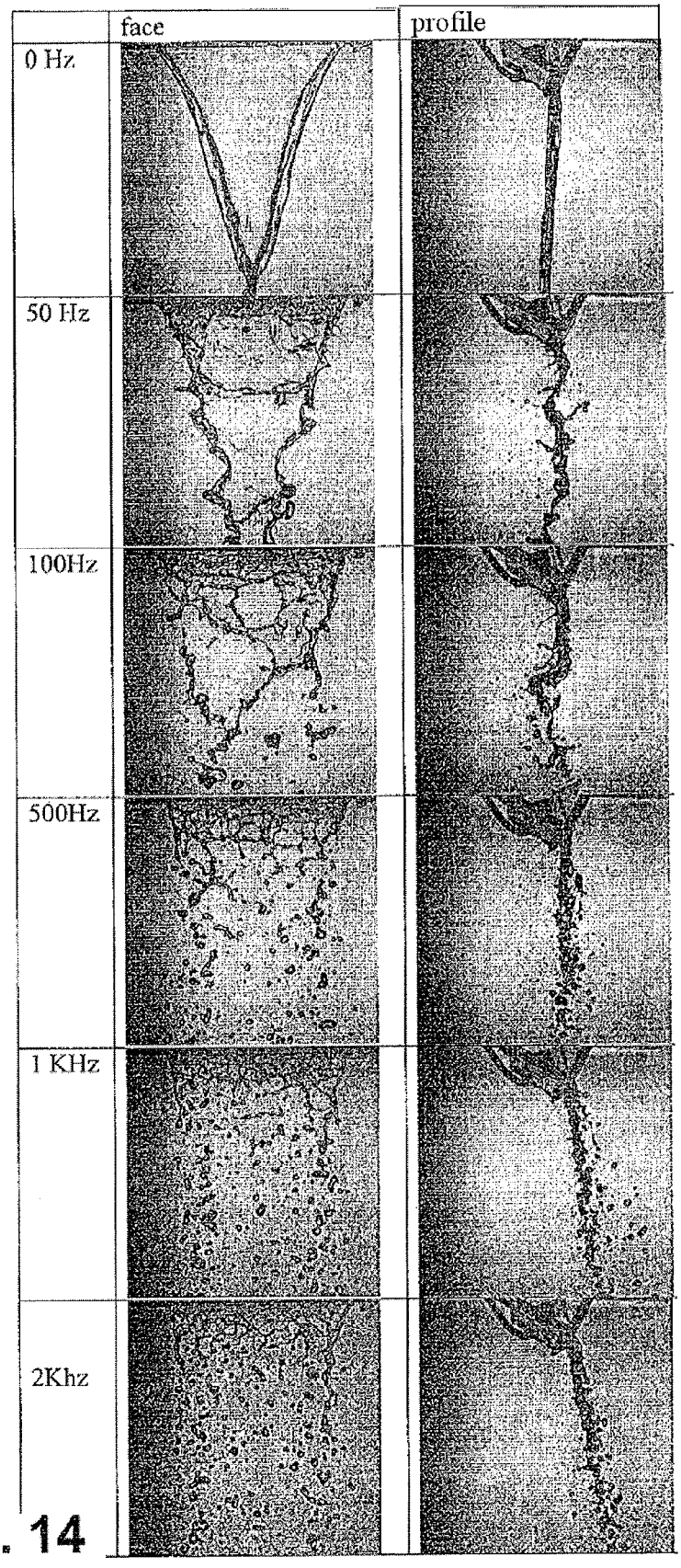
Figure 15:
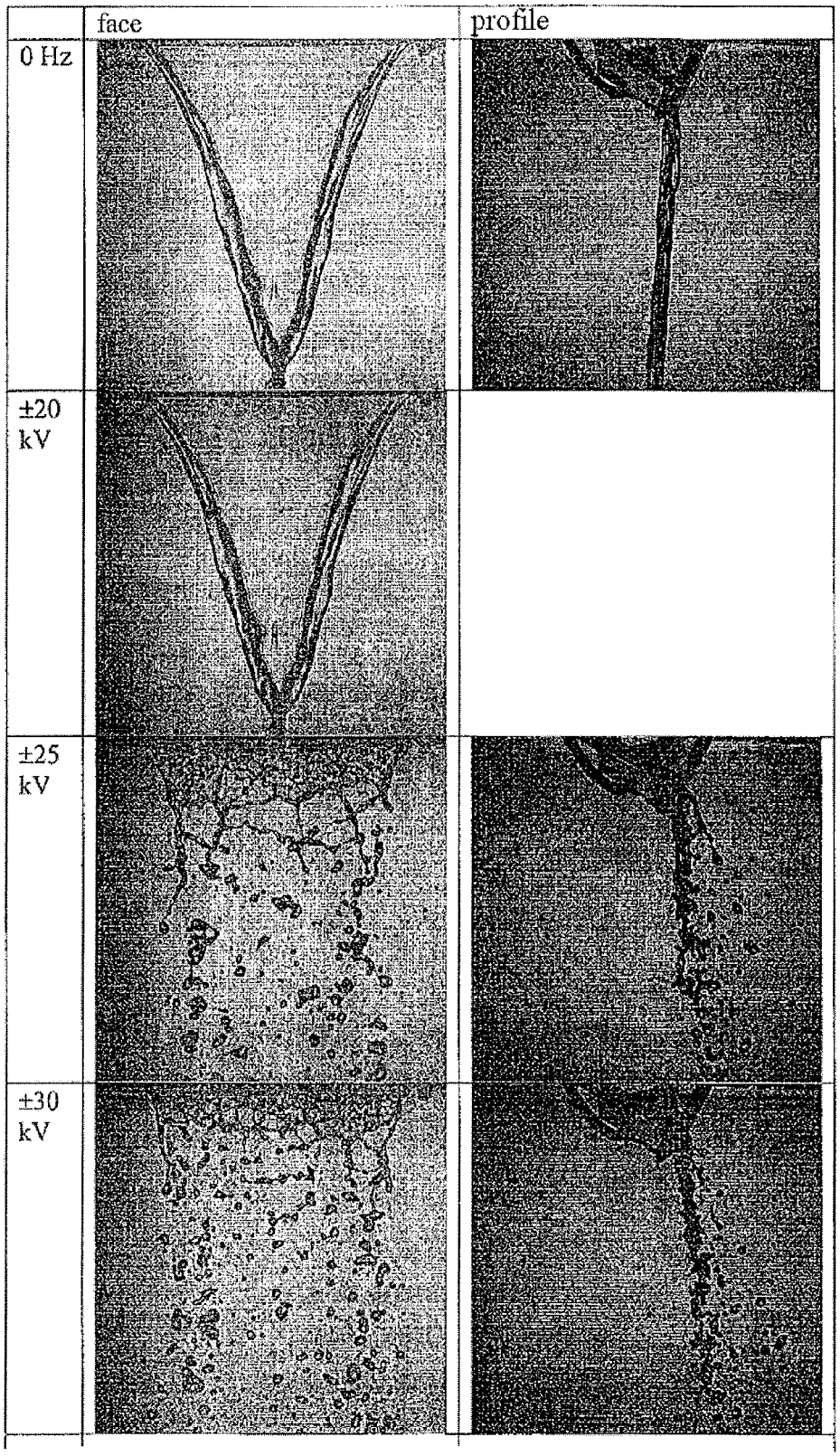
Figure 16:
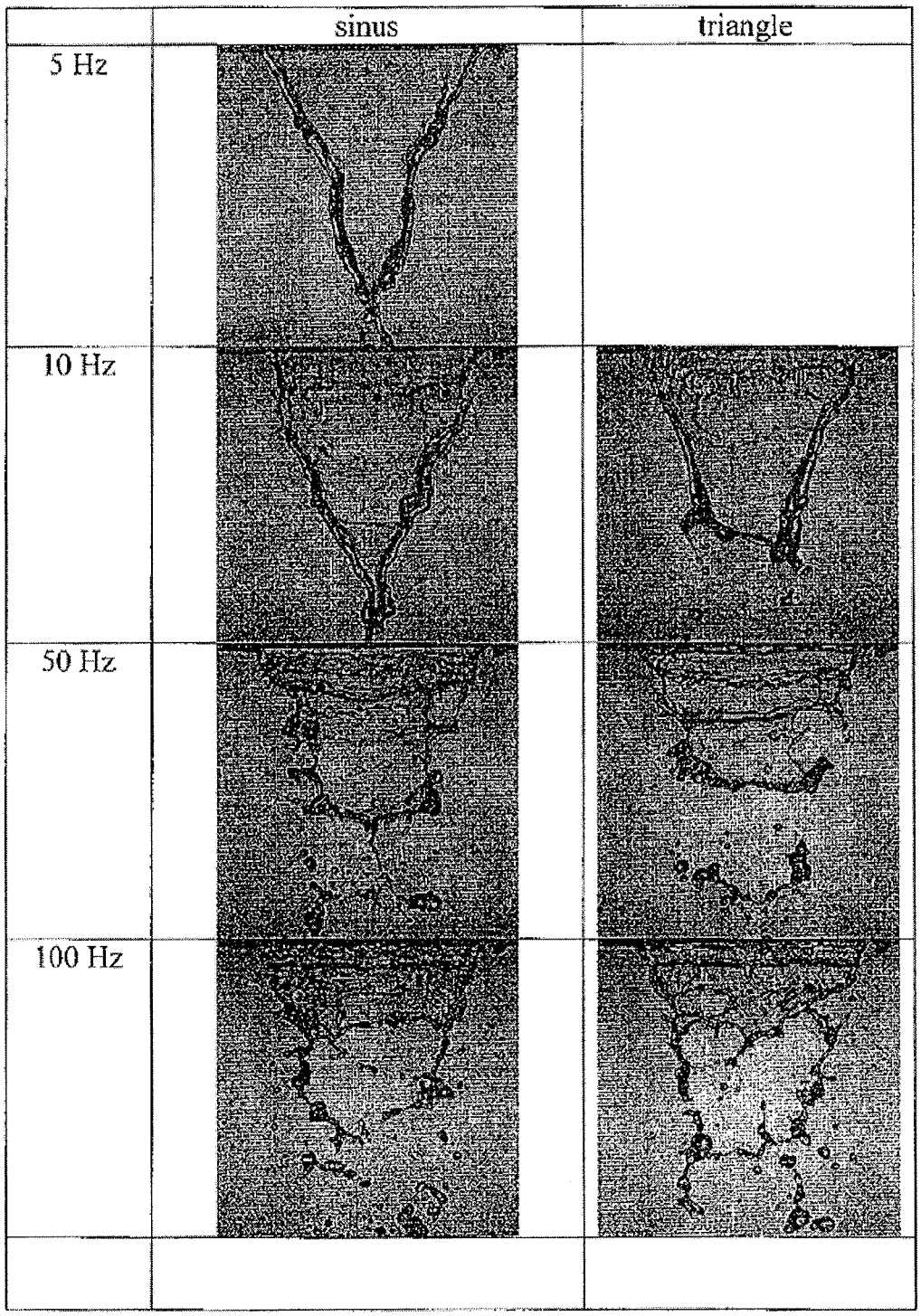
Figure 17:
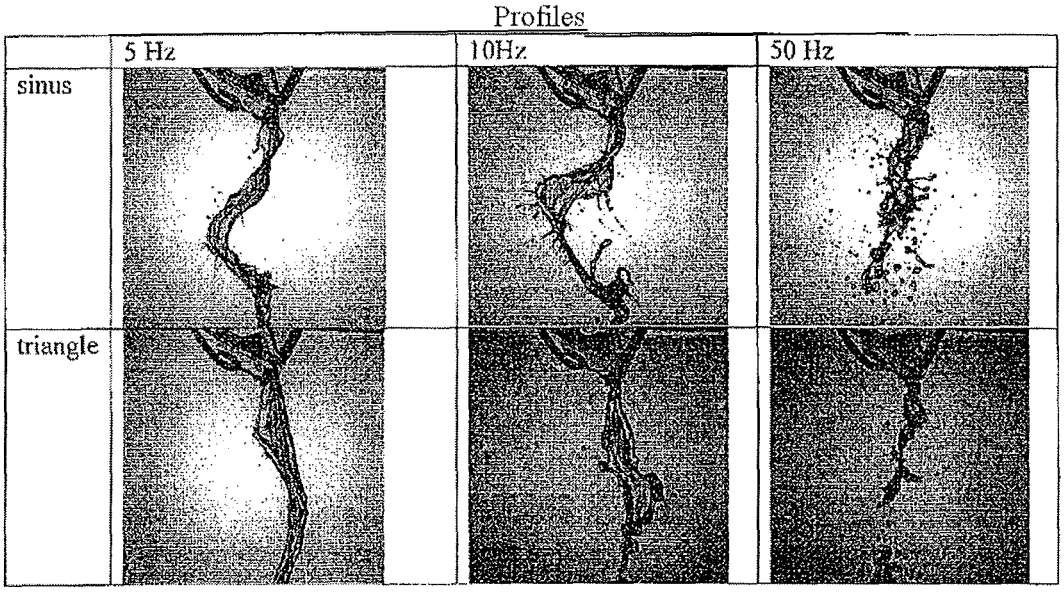

The abovementioned features of the present invention, and others, will be better understood on reading the following description of a number of exemplary embodiments of the invention, given as nonlimiting illustrations, said description being given in relation to the appended drawings, in which:

FIG. 1 is a partial schematic view in axial section of a device for spraying a sheet according to the invention with symmetry of revolution for the fuel injector, FIG. 2 is a partial schematic view in longitudinal section along the plane II-II of FIG. 9, of a device according to the invention for spraying a flat sheet of fuel corresponding to a simplified variant of FIG. 1, FIG. 3 is an enlarged schematic view of the spraying end of the device of FIG. 2, showing in particular an example of the form and arrangement of the two electrodes with which this device is equipped, FIG. 4 is a bottom view of the first nozzle body of the spraying device of FIG. 2 (without the first electrode with protruding end extending this first body), FIG. 5 is a lateral view of this first nozzle body of FIG. 2 shown without its first electrode, FIG. 6 is a front view of this first nozzle body of FIG. 2 shown without its first electrode, FIG. 7 is a bottom view of the second nozzle body of the spraying device of FIG. 2, showing the recess formed in this nozzle body to receive the second electrically insulated electrode therein, FIG. 8 is a lateral view of this second nozzle body of FIG. 2, FIG. 9 is a front view of this second nozzle body of FIG. 2, FIG. 10 is a juxtaposition of two photographs showing, by front views, two sheets obtained by the device of FIG. 2, the photograph on the left showing the non-atomized sheet obtained without the electrostatic means of the invention, and that on the right showing the atomized sheet according to the invention which is obtained by these means, FIG. 11 is a juxtaposition of two other photographs showing, in profile view, two sheets obtained by the device of FIG. 2, the photograph on the left showing the non-atomized sheet with no beat obtained without the electrostatic means of the invention, and that on the right showing the sheet not atomized but subjected to the beat which is obtained by these means, FIG. 12 is a juxtaposition of two rows of four photographs each, showing, in front view, for four different sheet speeds, the latter in the non-atomized state in the top row (i.e. without the electrostatic means) and in the atomized state in the bottom row (i.e., with these means, via a square electrical signal with a frequency of 2 kHz and ±30 kV amplitude), FIG. 13 is a juxtaposition of two rows of four photographs, each showing the sheets of FIG. 12, in profile view (i.e., for the same sheet speeds, in the non-atomized state in the top row and in the atomized state in the bottom row via the same electrical signal), FIG. 14 is a juxtaposition of six rows of two photographs each, showing, in front view (for the photographs on the left) and in profile view (for those on the right), the influence, on the atomization of the sheet, of the frequency of the square electrical signal of amplitude ±30 kV used together with these means, the speed of the sheet being 1 m/s, FIG. 15 is a juxtaposition of four rows of two photographs each (apart from the second row) showing, in front view (for the photographs on the left) and in profile view (for those on the right), the influence, on the atomization of the sheet, of the amplitude of the square electrical signal of frequency 1 kHz used together with these means, FIG. 16 is a juxtaposition of four rows of two photographs each (apart from the first row) showing the influence, on the beat of the sheet, of the form of the signal (sinusoidal for the photographs on the left and triangular for those on the right) and of the frequency of this signal of amplitude ±30 kV used together with these means, the speed of the sheet being 1 m/s, and FIG. 17 is a juxtaposition of two rows of three photographs each, showing the influence, on the beat of the sheet, of the form of the signal (sinusoidal for the top row and triangular for the bottom row) and of the frequency of this signal (with three frequencies for each row) of amplitude ±30 kV used together with these means, the speed of the sheet being 1 m/s.

The device 1 for spraying liquid 2 illustrated in FIG. 1 represents a preferred embodiment of a nozzle for injecting fuel according to the invention. As will be explained below, the nozzle 1 can be used by choice to atomize the fuel 2 or to control the beat of its oscillation, and it essentially comprises:

a first radially internal, electrically insulating and hollow tube-shaped nozzle body 3 with a cylindrical outer surface 4, the internal space of which is advantageously designed to convey a central jet of air 5 radially inside the sheet of fuel 2 sprayed by the nozzle 1 (cylindrical in the diagram of FIG. 1, it being understood that this sheet could be tapered) so as to improve the atomization thereof, for example, this first body 3 ending with a tapered internal surface 6 which diverges radially outward and which is covered with a first electrode 7 (for example metallic) which hugs this surface 6 and which has a rectilinear axial section ending with a protruding point 7*a* radially outside the outer surface 4 so as to be in contact with the sprayed fuel 2, a second radially external, electrically insulating and hollow tube-shaped nozzle body 8 with a cylindrical inner surface 9, the external space of which is advantageously designed to convey another peripheral jet of air 10 radially outside the sprayed sheet of fuel 2, this second body 8 ending with a tapered outer surface 11 which converges radially inward so as to end substantially facing the point 7*a* of the first electrode 7, and which encloses within its mass a second electrode 12 (for example metallic) in immediate proximity to the downstream end of this second body 8 and therefore to the first electrode 7, and means 13 for generating and controlling an alternating electrical signal applied between the electrodes 7 and 12 (with a form, amplitude and frequency that can be adjusted, as explained below), which are linked to a high voltage source HT included in these means 13.

The relative positioning of the two nozzle bodies 3 and 8 defines a narrow channel 14 for conveying the fuel 2 to be sprayed which is of annular section, with a spacing E between these two bodies 3 and 8, for example of between 100 μm and 500 μm, thus determining the thickness of the sheet of sprayed fuel 2 (with an output speed for example of the order of 1 m/s).

More specifically, the first electrode 7 is designed to directly inject electrical charges into the fuel 2 in which its point 7*a* is immersed in operation, by serving as an injector lip for the nozzle 1 because this electrode 7 partially constitutes the edge 15 of the spraying orifice of the nozzle 1. This direct injection at the point 7*a* is produced by virtue of an electrostatic field of very high intensity (several MV/cm, possibly ranging up to 10 MV/cm) that is generated at this point 7*a* by the high voltage HT applied between the two electrodes 7 and 12, by virtue of the sufficiently small radius of curvature of this point 7*a* which is, for example, approximately 10 μm. As for the material of the first body 3 forming the insulating support for this first electrode 7, it is chosen to have a low permittivity $\in_r$ to maximize the intensity of the electrostatic field in the vicinity of the point 7*a*, this permittivity preferably being less than that of the liquid 2 to be sprayed, or less than 2.2 for a diesel fuel of "gas oil" type for example.

The second electrode 12 is entirely embedded in the second nozzle body 8 which electrically insulates it to prevent the formation of electric arcs between the two electrodes 7 and 12. The electrode 12 has a geometry without corners or sharp edges (advantageously convex or rounded, being overall of toroidal form in the example of FIG. 1) which limits the electrical field on its surface and the stresses on the insulating material which is in contact with this electrode 12. This insulating material has a dielectric strength that is chosen to be as high as possible, and a permittivity that is also high ($\in_r$>5 preferably) to maximize the intensity of the electrostatic field in the vicinity of the first electrode 7.

As for the abovementioned two jets of air 5 and 10 which are designed to blow onto the respectively inner and outer faces of the emitted sheet 2, their speed can vary from 30 m/s to 200 m/s, by way of example.

It will be noted that the electrostatic injector 1 according to the invention of FIG. 1 is distinguished only from an injector of the prior art by the addition and the specific arrangement of the two electrodes 7 and 12 in relation to the means 13 for generating and controlling the alternating electrical signal between these electrodes 7 and 12. In other words, the general architecture of such a known injector has not been modified, the electrostatic effect being advantageously superimposed or not on the aeromechanical effect, which makes it possible to have only a mechanical action, only an electrostatic action or even both of these actions simultaneously for the atomization of the fuel 2.

As explained previously, it should be noted that the sheet of fuel 2 charged in this way undergoes the action of the electrostatic forces which result, by choice, either in its atomization, or in its controlled oscillation, depending on the electrical signal applied between the electrodes 7 and 12, and that this atomization or the control of this oscillation are optimized by the respective geometries of these electrodes 7 and 12 which are designed to maximize the electrostatic field on the first electrode 7 and therefore the direct injection of the electrical charges into the fuel 2.

Tests have been carried out, with reference to FIGS. 2 to 9 (dimensions expressed in mm), on a fuel spraying nozzle 101 with flat spraying channel 114, this geometry having been retained for reasons of simplicity and because it is representative of the results obtained with a device with symmetry of revolution (i.e. axisymmetry, of the type of that of FIG. 1) with spraying channel 14 of annular section. For these tests, two flat prototypes of the same structure but produced with different electrically insulating materials were used, the first prototype having its two nozzle bodies 103 and 108 made of PVC and the second prototype made of "Plexiglas" (with a permittivity $\in_r$ of 4.5, a resistivity of $10^{15}$ Ω·m and a dielectric strength>40 kV/mm in alternating current). As for the fuel used, this was "gas oil" with a density equal to 860 kg/m$^3$, relative permittivity $\in_r$=2.2, resistivity ranging between $10^9$ and $10^{10}$ Ω·m and kinematic viscosity equal to 4.3 $10^{-6}$ m$^2$/s.

The spraying nozzle 101 that can be seen in these FIGS. 2 to 9 comprises two first and second nozzle bodies 103 and 108 which are respectively provided with the first and second electrodes 107 and 112 and which are essentially differentiated from those of FIG. 1 in that these bodies 103 and 108 each have a same geometry of rectangular transversal section, instead of the annular traversal section of those of FIG. 1 (this rectangular form can be seen in FIGS. 4 and 6 for the first body 103 and in FIGS. 7 and 9 for the second 108).

The upstream end of these two bodies 103 and 108 is, in the example of FIG. 2, topped by a cap 116 sealing a fuel tranquillization chamber 117 which has a rectangular longitudinal section and which is delimited by the respective internal faces of the two bodies 103 and 108, symmetrical to one another relative to the central fuel spraying channel 114. More specifically, the chamber 117 and this channel 114 are centered on the longitudinal axis of symmetry X of the nozzle 101, and a central orifice 116*a* formed in the cap 116 allows for the intake of the fuel into the chamber 117, which is narrowed with a right angle in proximity to the downstream end of the nozzle 101 by two shoulders 103*a* and 108*a* on the internal faces of the bodies 103 and 108. This channel 114 forms a terminal section of small width 1 (1 mm, see FIG. 3) which communicates upstream with the chamber 117 and culminates at the profiled downstream end of the nozzle 101 formed by the respective oblique external surfaces 103*b* and 108*b* of the two bodies 103 and 108.

The first electrode 107 (made of chrome-plated steel) is in the form of a flat blade which extends over the major part of the oblique external surface 103*b* of the first body 103 and which ends with a pointed end 107*a* obliquely protruding into the channel 114, so that this protruding end 107*a* partially defines the edge 115 of the downstream spraying orifice of the nozzle 101 (see FIG. 3) together with the sharp terminal edge of the second body 108, the width e between this protruding end 107*a* and this facing edge being, in this example, 300 μm.

As for the second electrode 112 (also made of chrome-plated steel), it is embedded, in this exemplary embodiment, in an insulating resin 112*a* of epoxy type which fills a cavity opening onto the oblique external surface 108*b* of the second body 108 in the profiled region thereof and in immediate proximity to said edge. It can be seen in FIGS. 2 and 3 that this insulating resin 112*a* thus forms a portion of the oblique surface 108*b* and is in contact with the insulating material (e.g. PVC or "Plexiglas") of the second body 108. This second electrode 112 has, in this example, an oblong and rounded longitudinal section which is substantially elliptical.

It will be noted that the connection system for the electrodes 107 and 112 has not been represented in these FIGS. 2 to 9 for reasons of clarity.

Substantially flat sprayed sheets were thus obtained, with sheet speeds of between 0.5 m/s and 2 m/s, each sheet having a rectangular section with a length approximately equal to 8 cm (in the transversal direction of FIGS. 6 and 9) and with a width approximately equal to 4 cm (in the longitudinal direction of these figures), with a sheet thickness of approximately 300 μm (corresponding to the abovementioned width e of the spraying orifice).

FIGS. 11 to 17 show sheets obtained in tests performed without any flow of air (i.e. only by the electrostatic means comprising these electrodes 107 and 112), by means of the spraying device 101 according to these FIGS. 2 to 9 in which the nozzle bodies 103 and 108 are made of "plexiglas" (apart from the abovementioned epoxy resin 112*a*).

In the left hand image of FIG. 10, it can be seen that the sprayed sheet of fuel, not atomized (because of the absence of any electrical signal generated between the electrodes), is perfectly stable seen from the front, whereas the right hand image of this FIG. 10 illustrates the effective atomization obtained by only the forced injection of electrical charges according to the invention (via an alternating electrical signal), the electrostatic means thus being capable on their own of atomizing the sheet.

In the left hand image of FIG. 11, it can be seen that the sprayed sheet of fuel, not atomized (because of the absence of any electrical signal), is perfectly linear (i.e. without beat) when seen in profile, whereas the right hand image of this FIG. 11 shows that the generation of a suitable alternating signal between the electrodes (see below) makes it possible to constrain the sheet of fuel with a given beat of oscillations.

The top row of images of FIG. 12 illustrates, by front view, four sprayed sheets without atomization (because of the absence of any electrical signal) at respective speeds of 0.6 m/s, 1 m/s, 1.5 m/s and 2 m/s, whereas the bottom row of images of this FIG. 12 shows the atomization obtained according to the invention at these four sheet speeds with a square electrical signal of 2 kHz and amplitude ±30 kV.

The top row of images of FIG. 13 illustrates, in profiled view, four sprayed sheets without atomization (because of the absence of any electrical signal) at these same four speeds, whereas the bottom row of images of this FIG. 13 shows the atomization obtained according to the invention at these sheet speeds via the same square electrical signal of 2 kHz and amplitude ±30 kV. It can be seen in this bottom row that the large drops (1 mm to 3 mm in diameter) which mostly originate from the edges of the sheet are visible in the center, and that a multitude of small drops of very small diameter (less than 100 μm) are also visible on either side of the central jet.

FIG. 14 shows the influence on the quality of the atomization obtained (with a sheet speed of 1 m/s) of the frequency of a square electrical signal of amplitude ±30 kV, this frequency varying from 0 Hz in the top row (i.e. in the absence of any signal) to the maximum frequency of 2 kHz in the bottom row. It can be seen that the use of high frequencies (i.e. at least 500 Hz) and preferably of between 1 and 2 kHz achieves a satisfactory atomization of the sheet.

FIG. 15 shows the influence on the quality of the atomization obtained of the amplitude of the 1 kHz square electrical signal. It can be seen that this amplitude should, in this example, be greater than ±20 kV to obtain a finely atomized sheet.

The two columns of images of FIG. 16 (front views) show the influence on the sheet beat obtained from the form and the frequency of the alternating signal, for a same signal amplitude equal to ±30 kV and for a fuel speed of 1 m/s. The left hand column illustrates the sheets obtained for a sinusoidal signal and that on the right illustrates those for a triangular signal, in both cases for frequencies ranging from 5 Hz to 100 Hz.

The two rows of images of FIG. 17 (profile views) complement these views of FIG. 16 for three of these frequencies (5 Hz, 10 Hz and 50 Hz) and show the beat obtained for the sinusoidal (top row) and triangular (bottom row) signals.

It emerges from these FIGS. 10 to 17 that the spraying devices according to the invention operate satisfactorily with all the conventional alternating signal types (i.e. of square, sinusoidal, triangular and even pulsed type). More specifically, the specific use of a low frequency (greater than 50 Hz) associated with a "soft" signal of sinusoidal or triangular type makes it possible to obtain a beat of the sheet without atomization, whereas the use of high frequencies (up to 2 kHz) makes it possible to obtain a fine atomization of the sheet (atomizations of excellent quality have been obtained with a 2 kHz square signal). It is nevertheless possible to envisage atomizing the sheets satisfactorily (i.e. with an optimized secondary atomization) with a device according to the invention at alternating signal frequencies greater than 2 kHz.

The invention claimed is:

1. A device for spraying, a liquid that can be electrically insulating at least through electrostatic forces, the device being designed to atomize this liquid or to control the beat of the oscillations thereof, this device comprising a nozzle which forms a channel for feeding the liquid to at least one orifice for spraying said liquid out of the device and which incorporates, in proximity to this orifice, a first electrode and a second electrode configured to inject electric charges into the liquid, wherein the edge of this orifice comprises, on one side of the channel, at least one protruding end of the first electrode which protrudes into this channel and which is configured to be in contact with the liquid and, on another side of the channel, an electrically insulating nozzle body in which the second electrode is embedded adjacent to the first electrode, so that the intensity of the electrostatic field at said or each protruding end is maximized.

2. The device as claimed in claim 1, wherein said channel is delimited by first and second electrically insulating nozzle bodies which are mounted facing one another and which respectively incorporate said first and second electrodes in profiled regions of these bodies ending at said spraying orifice, the first electrode extending on a first wall inside said channel defining the profiled region of the first body and ending beyond this wall by said or each end protruding into the channel, and the second electrode being adjacent to a second wall outside the channel defining the profiled region of the second body.

3. The device as claimed in claim 2, this device being suitable for spraying a fuel as liquid, wherein said first nozzle body has a relative permittivity $\in_r$ less than or equal to 10, and in that said second nozzle body has a relative permittivity $\in_r$ equal to or greater than 2, so as to further maximize the intensity of the electrostatic field in the vicinity of said first electrode.

4. The device as claimed in claim 3, wherein it is capable of generating said local electrostatic field with an intensity greater than 1 MV/cm at said or each protruding end when an alternating voltage is applied between said first and second electrodes.

5. The device as claimed in claim 2, wherein said first nozzle body is situated radially inside said second nozzle body which surrounds it concentrically so that said first and second walls are respectively divergent and convergent toward said channel, and in that said means for feeding the gaseous flows are located radially inside this first body and radially outside this second body.

6. An injector of a fuel that can be electrically insulating for a combustion chamber of a heat engine of a land, airborne or space vehicle, wherein it comprises a device suitable for atomizing this fuel in the form of a sheet as claimed in claim 5.

7. The device as claimed in claim 1, wherein said or each protruding end has a main radius of curvature of between 5 μm and 15 μm and is preferably pointed, said spraying orifice having a smaller transversal dimension of between 100 μm and 500 μm.

8. The device as claimed in claim 1, wherein said first electrode is overall rectilinear in longitudinal section, said second electrode having a convex outer surface which is elliptical or circular in longitudinal section so as to minimize the intensity of the electrostatic field at this surface.

9. The device as claimed in claim 1, this device being suitable for atomizing a fuel as liquid in the form of a sheet, wherein it also comprises means for feeding at least one gaseous flow downstream of said spraying orifice so as to optimize the atomization of the fuel sprayed by the device.

10. The device as claimed in claim 1, wherein said channel has a substantially rectangular transversal section so as to spray the liquid in the form of a flat sheet, said first electrode having overall the form of a flat plate and said second electrode having a bar-shaped geometry, each electrode being independently continuous or discontinuous seen in transversal section.

11. The device as claimed in claim 1, wherein said channel has an overall annular transversal section so as to spray the liquid in the form of a sheet with symmetry of revolution, said first electrode having a substantially divergent tapered form toward said or each protruding end and said second electrode having a substantially toroidal form concentrically surrounding the first electrode, each electrode being independently continuous or discontinuous seen in transversal section.

12. The device as claimed in claim 1, wherein it forms an electro-hydrodynamic pump for a heat exchanger with no rotating parts, intended to equip an air or space vehicle with heat engine.

13. The use of a device as claimed in claim 1 for atomizing a liquid chosen from the group consisting of heat-transfer liquids, cutting oils for machine tools and liquids for cleaning soiled surfaces.

14. A method for spraying, at least by electrostatic forces, a liquid that can be electrically insulating by atomizing it or by controlling the beat of the oscillations thereof, wherein it consists in using a device as claimed in claim 1 by applying, between said first and second electrodes, an alternating voltage signal, the amplitude of which is several kV, to obtain a local electrostatic field at said or each protruding end with an intensity greater than 1 MV/cm, electrical charges thus being directly injected into the liquid leaving the device at this end.

15. The method as claimed in claim 14, wherein, to atomize this liquid, a frequency of this signal at least equal to 1 kHz is used, this signal being square and having a frequency equal to or greater than 2 kHz.

16. The method as claimed in claim 14, wherein, to control the beat of the oscillations of this liquid without atomizing it, a frequency of this signal of between 5 Hz and 100 Hz is used, this signal being of sinusoidal or triangular type and with a frequency substantially equal to 50 Hz.

17. The method as claimed in claim 14, wherein the liquid is set in motion in said channel with a speed of between 0.5 m/s and 2 m/s, and in that a sheet that is substantially flat or with symmetry of revolution for the sprayed liquid with a thickness of between 200 μm and 500 μm is obtained by also feeding at least one gaseous flow downstream of said spraying orifice and at a speed of between 30 m/s and 200 m/s, to optimize the atomization of the fuel sprayed by the device.

* * * * *